United States Patent [19]

Bühler

[11] Patent Number: 4,715,547

[45] Date of Patent: Dec. 29, 1987

[54] BALL MILL

[75] Inventor: Gerhard Bühler, Rheinfelden, Switzerland

[73] Assignee: Fryma Maschinen A.G. Rheinfelden, Rheinfelden, Switzerland

[21] Appl. No.: 804,264

[22] Filed: Dec. 3, 1985

[30] Foreign Application Priority Data

Dec. 6, 1984 [DE] Fed. Rep. of Germany ..... 3444575

[51] Int. Cl.[4] ..... B02C 17/04; B02C 17/18

[52] U.S. Cl. ..... 241/176; 241/180

[58] Field of Search ..... 241/172, 179, 176, 67, 241/170, 171, 173, 180, 69

[56] References Cited

U.S. PATENT DOCUMENTS 1,605,025 11/1926 Hildebrandt ..... 241/179 X 4,304,362 12/1981 Bühler ..... 241/176

*Primary Examiner*—Timothy V. Eley

*Attorney, Agent, or Firm*—Lahive & Cockfield

[57] ABSTRACT

A drive body (4) which is rotationally driven via a shaft (6) projects into a fixed housing (1) closed by a cover (2). The annular-gap-shaped grinding chamber (M) formed between the housing (1) and the drive body (4) is partially filled with grinding balls, for example to 75%, and grinding stock flows continuously through it. The grinding stock enters from a product inlet (8) via the inlet gap (7) into the grinding chamber and leaves the latter through the discharge gap (3) which does not let through the grinding balls.

The grinding chamber (M) is continuously widened from the mouth of the inlet gap (7) up to a deflection point (U).

This results in a better starting behavior and a substantially more effective grinding, because a considerably higher grinding ball filling ratio can be achieved at the same circulating time of the grinding balls.

5 Claims, 2 Drawing Figures

BALL MILL

Figure 1:
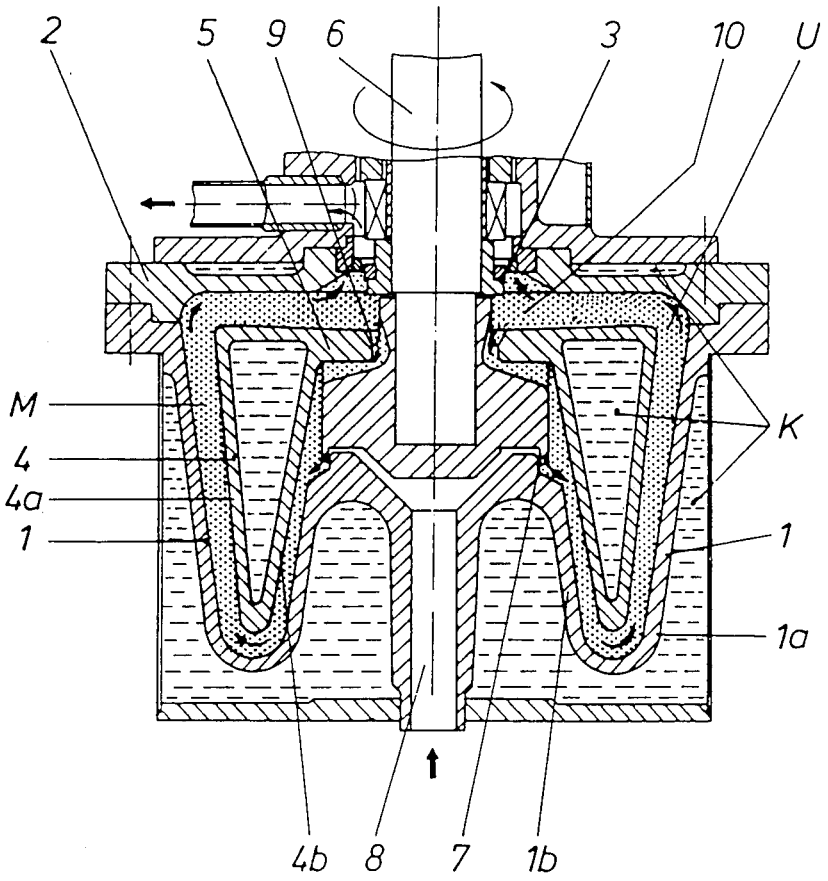

The invention relates to a ball mill for the continuous crushing and dispersing of a solid grinding stock which is conveyed along in a fluid, having an annular-gap-shaped, rotationally symmetric grinding chamber which is formed between a stator and a rotor coupled to a drive, has an at least approximately V-shaped cross-section on both sides of the vertical centre axis, and is provided with an inlet and an outlet for the circulating grinding stock, with the grinding chamber being partially filled with grinding balls which circulate continuously together with the grinding stock under the effect of the rotor rotation during operation of the ball mill.

A ball mill of the type of construction which comes into consideration here is described, for example, in the German Offenlegungsschrift No. 2,811,899. The grinding stock, for example a more or less highly fluid mass, flows through the grinding chamber defined by two surfaces, which are approximately in the shape of a "ring cake", and at the same time are crushed or dispersed by the grinding balls conveyed along with the mass. The grinding balls are separated from the grinding stock before the grinding stock outlet and are delivered again to the grinding chamber.

With regard to achieving an optimum grinding effect, in the case of a constant ball size, the conflicting requirements for on the one hand, a circulating time of the grinding balls which is as short as possible and, on the other hand for a high grinding ball filling ratio of 75 to 80% must conform. In the use of the hitherto known ball mills, such a high filling ratio leads to inadmissibly high circulating times; on the other hand, achieving such an optimum filling ratio would be desirable with respect to optimum grinding.

Practice therefore shows that a definite limit is set on an optimum filling ratio increase by the rapid decrease in the circulating speed connected with this. Moreover, at relatively high filling ratios, the difficulty arises that the grinding balls form a solid mass during the stoppage periods, which requires an exceptionally high starting torque and generally jams the mill in extreme cases.

To remove these disadvantages and in particular to achieve a reliable starting of the ball mill at a relatively high filling ratio, it has already been proposed (German Offenlegungsschrift No. 3,022,809) to increase the clearance width of the grinding gap during the starting operation by 0.1 to 0.5 mm so as consequently to reduce the adhesion between the rotor and the stator walls which define the grinding chamber. However, the design effort connected with this solution is considerable.

Positive control of the circulating speed of the grinding bodies is also to be achieved by the invention described in the European patent application No. 111,703, according to which a separate conveying member is used for the return of the grinding bodies and therefore an elaborate and expensive mill design again has to be accepted.

The object of the present invention is to propose a ball mill of the abovementioned type which permits a high grinding ball filling ratio in the case of a short circulating time (or high circulating speed) of the grinding balls and therefore produces improved grinding, compared with the known designs, at a higher overall efficiency. At the same time, starting of the ball mill, in spite of a relatively high filling ratio, is also to be ensured independently of the viscosity of the grinding stock.

This object is achieved by the combination of features defined in the independent patent claim 1. Preferred embodiments are characterised in the dependent patent claims.

As has been shown by tests, the ball mill design according to the invention produces the following surprising results:

The gradual or progressive widening of the grinding chamber in the conveying direction involves a corresponding increase in the grinding chamber volume, because, on the one hand, the walls defining the grinding chamber and, on the other hand, the increase in the filling ratio of the grinding balls ensure more contact and mutual friction action.

Owing to the increasing grinding chamber crosssection, this improvement of the grinding action reaches its maximum in absolutely desirable manner precisely where the pre-ground finer particles are difficult to grind per se.

The starting torque is maintained within controllable limits without design effort required by additional couplings etc being necessary. Owing to the improved grinding ball circulation and the avoidance of ball jamming, the wear of the walls defining the grinding chamber is reduced, which is a decisive factor for the life of the ball mill.

By the widening of the grinding gap, production tolerances can be accommodated without the risk of an undesirable narrowing of the grinding gap.

An illustrative embodiment of the inventive subject matter is described below with reference to the attached drawing.

Figure 2:
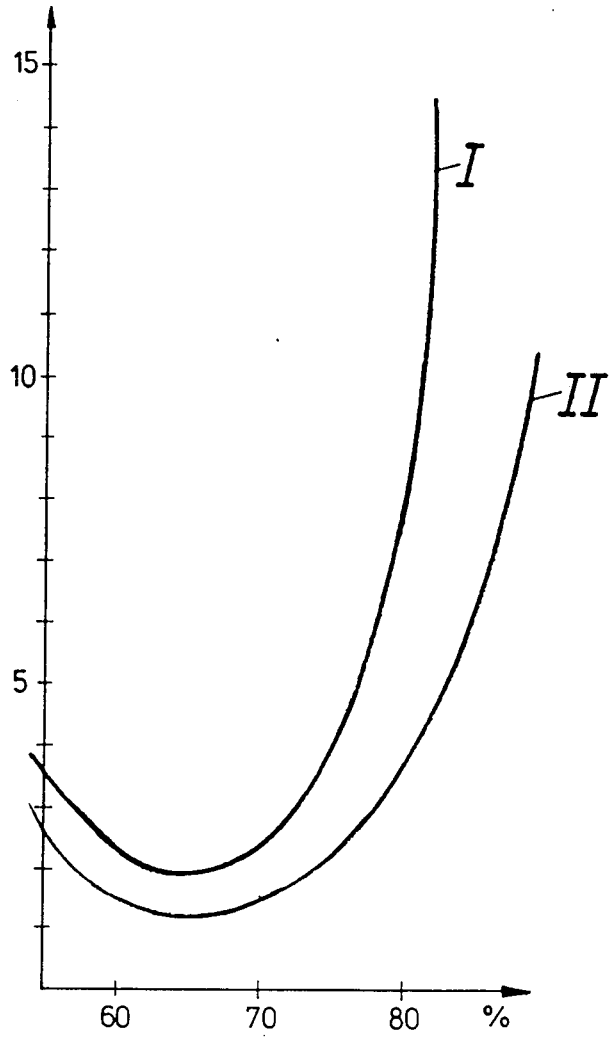

FIG. 1 shows a sectional representation of an embodiment of the ball mill according to the invention, and FIG. 2 shows with reference to the diagram the dependency between circulating speed and grinding ball filling ratio.

According to FIG. 1, a fixed housing 1 (stator) is closed by a cover 2, in which a grinding stock outlet 3 formed from a dividing gap is provided in known manner. A drive body 4 (rotor) projects into the space defined by two approximately conical terminating walls 1*a* and 1*b* which are inclined towards one another, which drive body 4 is also defined by two practically conical walls 4*a* and 4*b* inclined towards one another and is coupled to a rotationally driven shaft (6) via an upper, central web 5. The grinding chamber designated as M and formed between the housing 1 and the drive body 4 is connected to a product inlet 8 via the inlet gap 7. A cooling medium K is located outside the housing 1, above the cover 2 and inside the drive body 4 made as a hollow body.

The annular-gap-shaped grinding chamber M is partially filled with grinding balls and grinding stock flows through it during operation, which grinding stock flows in through the inlet gap 7 and leaves the grinding chamber M again through the outlet gap. The grinding balls which are carried along by the grinding stock and are in contact with the rotating drive body 4 circulate in the grinding chamber M with the grinding stock, but cannot leave the grinding chamber through the outlet gap 3 and return automatically through the return channels 9 into the grinding chamber M.

From the confluence of the inlet channels 7 up to the deflection point designated as U, from which the grinding stock flows to the outlet channels 3 via a radially inward-leading return-flow chamber 10, the grinding chamber cross-section is continuously increased, which produces the advantages specified at the beginning. This widening in the cross-section can on the one hand be in the form of a uniform, continuous increase in cross-section corresponding to FIG. 1; on the other hand, however, it is also possible to sub-divide the grinding chamber into several sections which are located one after the other in the conveying direction and are of constant cross-section, with the cross-section of the individual sections increasing gradually in the conveying direction.

A decisive factor for the surprising success confirmed by experiments is the increase in cross-section from the inlet 7 up to about the point U, by which means not only is the starting behaviour influenced to a considerable extent but also the grinding operation.

FIG. 2 shows with reference to a graph the result of comparative tests conducted. Curve I shows the dependency of the circulating time on the filling ratio (percentage proportion of the filling volume of the grinding balls to overall grinding chamber volume) of a known ball mill, whereas curve II reproduces the results achieved with a ball mill designed according to the invention. It turns out that the grinding chamber widening according to the invention permits a considerably greater filling ratio at the same circulating speed, by which means the grinding operation could be considerably intensified without the aid of expensive supplementary equipment.

The grinding chamber widening to be carried out according to the embodiment according to FIG. 1—as a divergence from the known parallel terminating walls - can be between 0.1° and 2°, but is preferably abbut 0.3°. In the Step widening mentioned, the respective difference in gap width of two adjacent grinding chamber sections is to be between 0.1 and 0.3 mm.

I claim:

1. A ball mill apparatus for the continuous crushing and dispersing of a solid grinding stock which is conveyed along in a fluid, comprising an annular-gap-shaped grinding chamber which is rotationally symmetric with respect to a vertical centre axis, formed between a stator and a rotor coupled to a drive, which chamber has an at least approximately V-shaped cross-section on both sides of the vertical centre axis and is provided with an inlet and an outlet for the circulating grinding stock, with the grinding chamber being partially filled with grinding balls which circulate continuously, together with the grinding stock, under the effect of the rotor rotation during operation of the ball mill, wherein the V-shaped cross-section of the grinding chamber increases in the conveying direction of the grinding stock from the grinding stock inlet to a confluence in an upper, radially inward-leading return-flow chamber.

2. Apparatus according to claim 1 wherein the v-shaped cross-section of the grinding chamber increases continuously from a confluence of inlet channels to a deflection point.

3. Apparatus according to claim 1, wherein the walls which define the V-shaped cross-section of the grinding chamber comprise an approximately conical stator wall and a corresponding conical rotor wall wherein said stator and rotor walls diverge from each other, in the conveying direction of the grinding stock, at an angle of between 0.1 and 2.0 degrees from an imaginary parallel wall arrangement.

4. Apparatus according to claim 3, wherein the angle of divergence is 0.3 degrees.

5. Apparatus according to claim 1, wherein the grinding chamber is sub-divided into several sections of constant cross-section, and wherein the cross-section of the entire grinding chamber increases gradually and incrementally from section to section in the conveying direction of the grinding stock.

* * * * *